US005732936A

United States Patent [19]

Lii

[11] Patent Number: 5,732,936

[45] Date of Patent: Mar. 31, 1998

[54] FAST C CLAMP

[76] Inventor: Liang-Kuen Lii, 58, Ma Yuan West St., Taichung, Taiwan

[21] Appl. No.: 630,863

[22] Filed: Mar. 29, 1996

[51] Int. Cl.[6] ..... B66F 3/00

[52] U.S. Cl. ..... 269/6

[58] Field of Search ..... 269/6, 3, 249, 269/216, 228, 143; 254/108, 106; 222/325–327, 391

[56] References Cited

U.S. PATENT DOCUMENTS

| | | | |
|---|---|---|---|
| 4,220,322 | 9/1980 | Hobday | 269/6 |
| 4,874,155 | 10/1989 | Goul | 269/6 |
| 4,932,638 | 6/1990 | Chen | 269/6 |
| 5,217,213 | 6/1993 | Lii | 269/6 |

*Primary Examiner*—Robert C. Watson

[57] ABSTRACT

A fast C-clamp comprises a generally C-shaped frame and a fixed jaw disposed in a front end of the frame. A fixed handle has an interior to receive a driving handle. The driving handle has an upper flange disposed on an upper end of the driving handle, a pivot hole and a rectangular hole formed on the upper portion of the driving handle. The driving handle and the fixed handle are fastened together. A holding seat is disposed in front of the fixed handle. A lower flange with a slot therein is disposed beneath the holding seat. A through hole is formed on the holding seat. The rear end of the frame is positioned in the slot. A round hole and a square hole are formed on the rear upper portion of the fixed handle. A shaft has a front end to connect a ball and a rear end to connect a holder. The ball is inserted in a rear portion of a movable jaw. A push plate with a circular hole thereon is disposed in the interior between a compression spring and the upper flange. A press plate has a center hole. The press plate is inserted in the square hole to be confined by a rear wall of the fixed handle. The shaft passes through the corresponding holes.

1 Claim, 3 Drawing Sheets

FAST C CLAMP

BACKGROUND OF THE INVENTION

The invention relates to a screw clamp such as a C-clamp. More particularly, the invention relates to a fast C-clamp.

A conventional C-clamp has a threaded rod which is slowly forward to a predetermined position to clamp an article. However, the forward motion of the threaded rod is very slow.

SUMMARY OF THE INVENTION

An object of the invention is to provide a C-clamp which can clamp an article tightly.

Another object of the invention is to provide a C-clamp which can clamp an article quickly.

Another object of the invention is to provide a C-clamp which is easily assembled.

Accordingly, a fast C-clamp comprises a generally C-shaped frame and a fixed jaw disposed in a front end of the frame. A connecting end is disposed at the rear end of the frame. A fixed handle has an interior to receive a driving handle. The driving handle has an upper flange disposed on an upper end of the driving handle, a pivot hole and a rectangular hole formed on the upper portion of the driving handle. The driving handle and the fixed handle are fastened together. A circular holding seat is disposed in a front of the fixed handle. A lower flange with a slot therein is disposed beneath the circular holding seat. A through hole is formed at the center of the circular holding seat. The connecting end is positioned in the slot stably. A round hole is formed on the rear upper portion of the fixed handle. A square hole is formed on the rear upper portion of the fixed handle under the round hole. A round shaft has a front end to connect a ball and a rear end to connect a holder. The ball is inserted in a rear portion of a movable jaw. A push plate with a circular hole thereon is disposed in the interior between a compression spring and the upper flange. A press plate has a center hole. The press plate is inserted in the square hole, and the press plate is confined by a rear wall of the fixed handle. The shaft passes through the through hole, the circular hole, the rectangular hole, the elastic spring, and the center hole. When the driving handle is pressed toward the fixed handle, the upper flange forces the slant push plate to drive the shaft to move forward. The slant press plate blocks the shaft to move rearward. When the lower portion of the press plate is pressed forward to abut the fixed handle, the middle portion of the press plate is perpendicular to the shaft so that the press plate will not block the motion of the shaft.

DETAILED DESCRIPTION OF THE INVENTION

Figure 1:
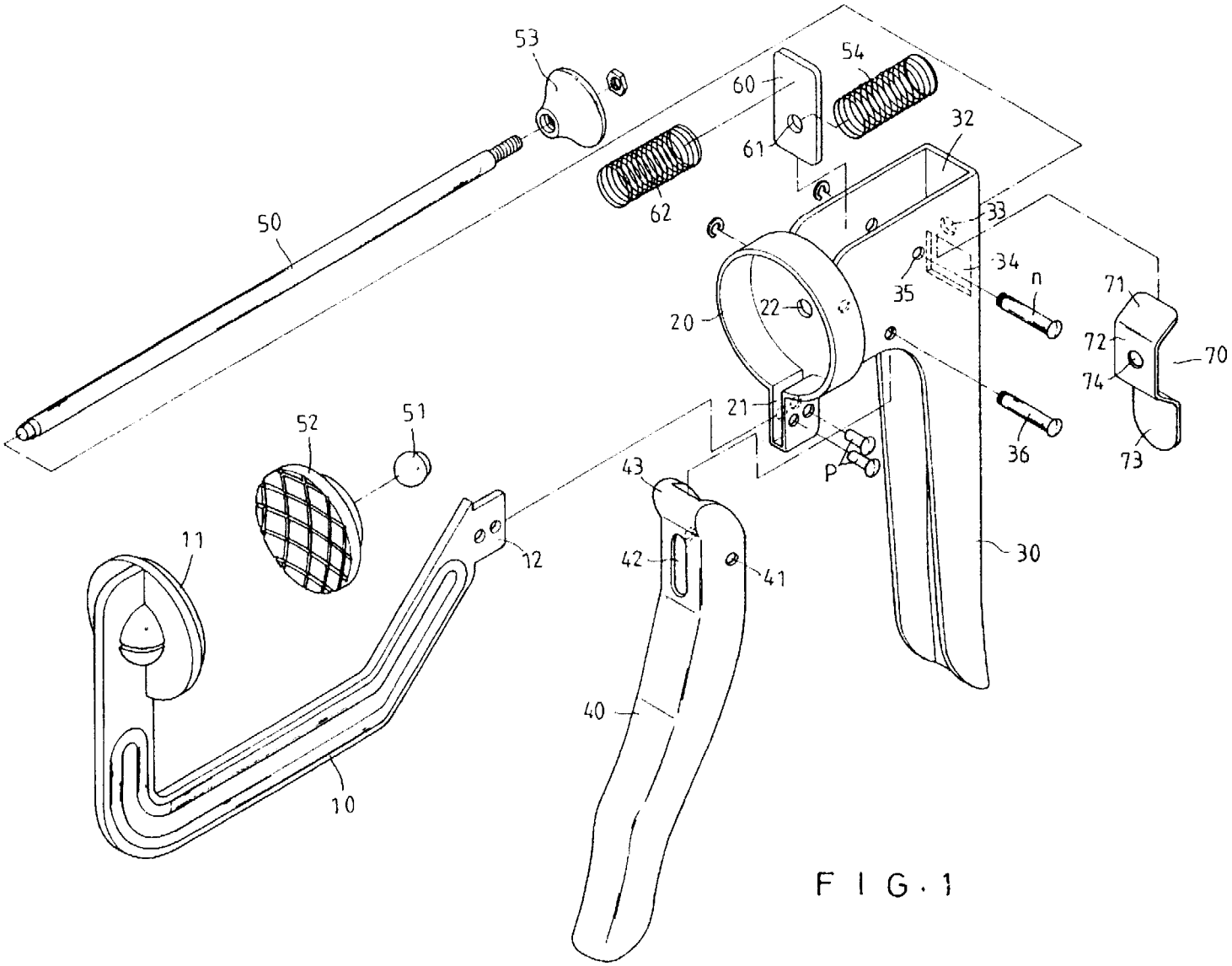
FIG. 1 is a perspective exploded view of a fast C-clamp of a preferred embodiment in accordance with the invention.
Figure 2:
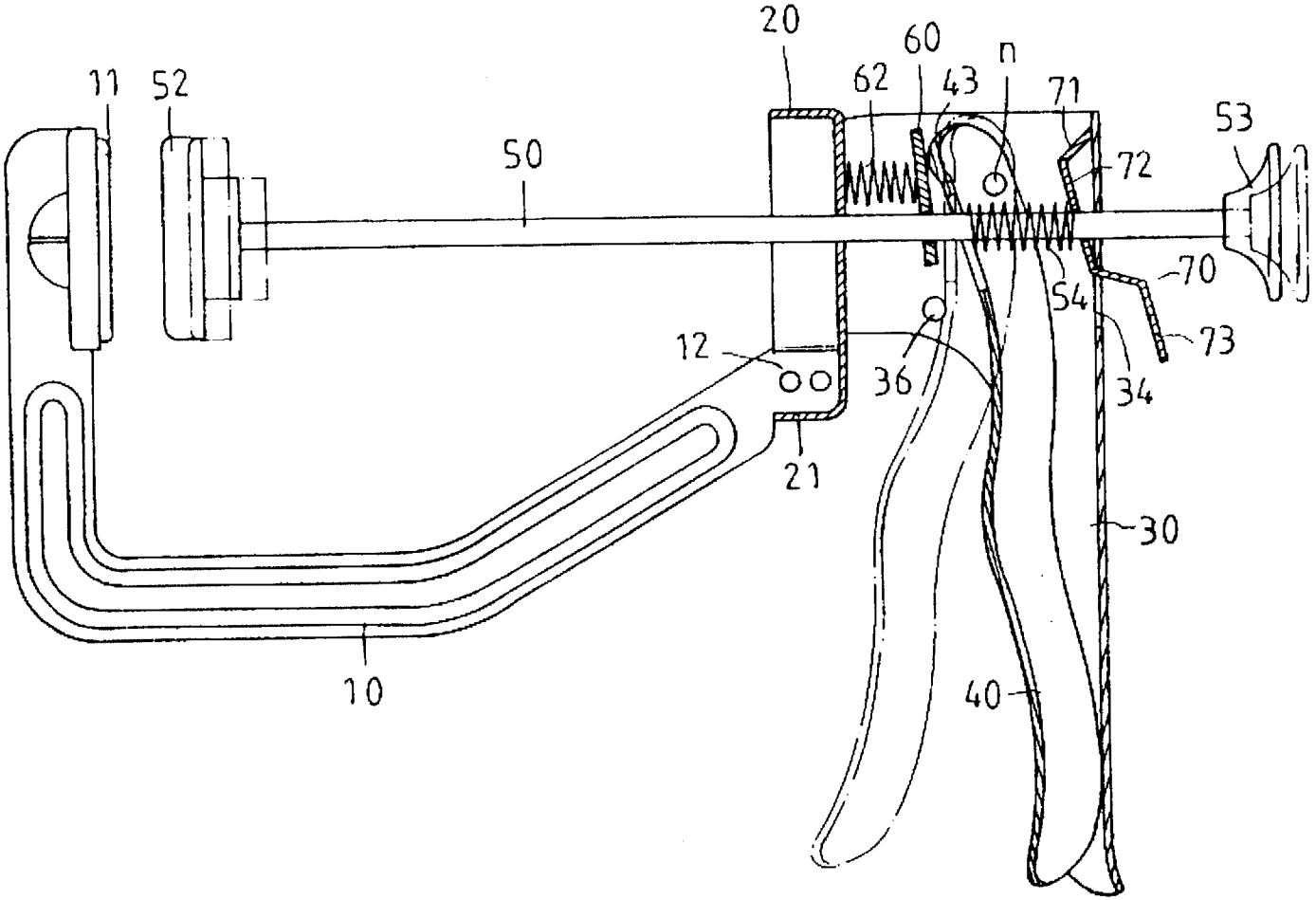
FIG. 2 is a schematic view illustrating the operation of a fast C-clamp.
Figure 3:
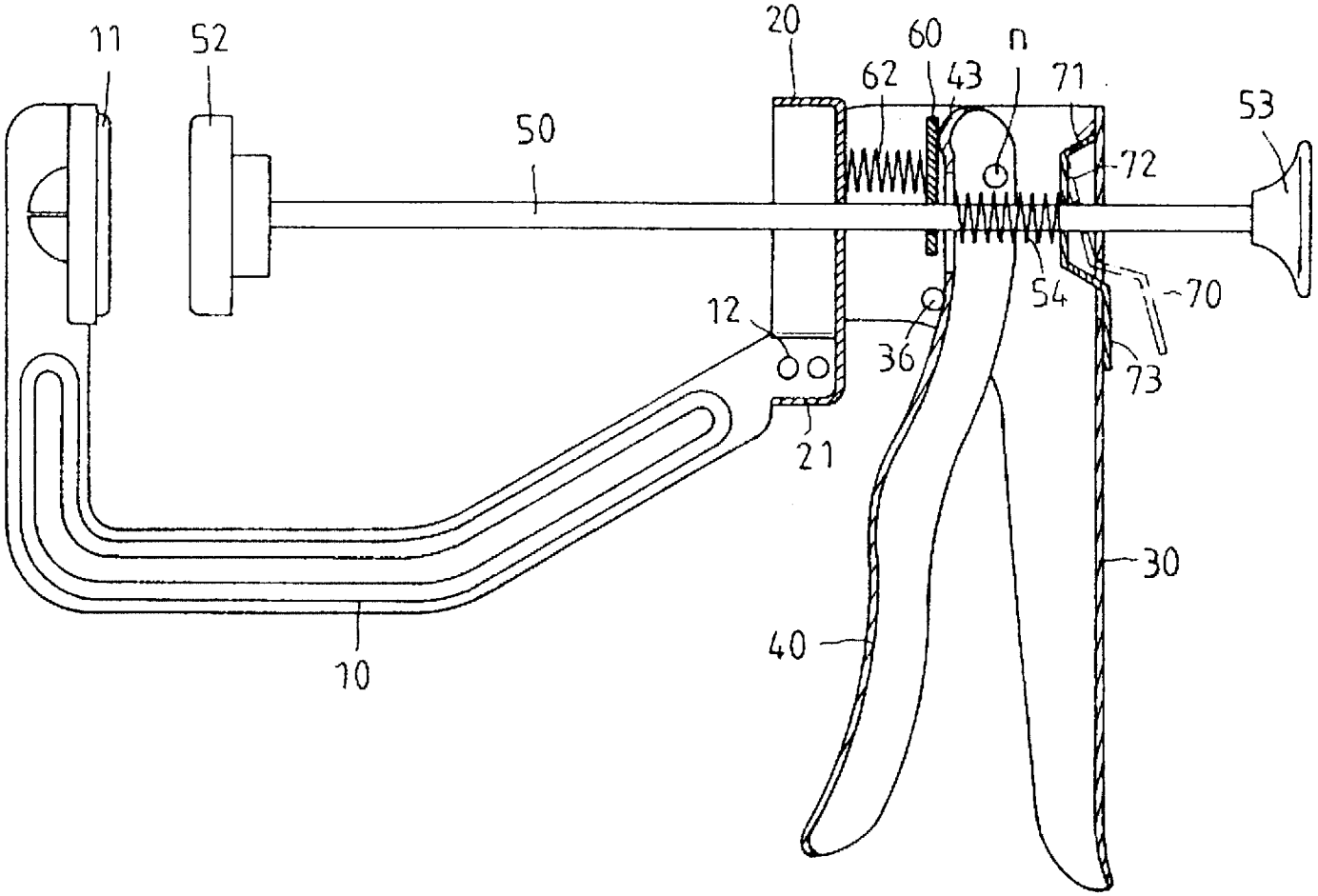
FIG. 3 is another schematic view illustrating the operation of a fast C-clamp.

Referring to FIGS. 1 to 3, a fast C-clamp comprises a generally C-shaped frame 10 and a fixed jaw 11 disposed in the front end of the frame 10. A connecting end 12 is disposed at the rear end of the frame 10. A fixed handle 30 has an interior 32 to receive a driving handle 40. The driving handle 40 has an upper flange 43 disposed on an upper end of the driving handle 40, a pivot hole 41 and a rectangular hole 42 formed on the upper portion of the driving handle 40. The fixed handle 30 has a connecting hole 35 thereon. A pin n passes through the connecting hole 35 and the pivot hole 41 to fasten the driving handle 40 and the fixed handle 30 together. A circular holding seat 20 is disposed in a front of the fixed handle 30. A lower flange with a slot 21 therein is disposed beneath the circular holding seat 20. A through hole 22 is formed at the center of the circular holding seat 20. The connecting end 12 is inserted in the slot 21 and fastened by at least a rivet p. A round hole 33 is formed on the rear upper portion of the fixed handle 30. A square hole 34 is formed on the rear upper portion of the fixed handle 30 under the round hole 33. A round shaft 50 has a front end to connect a ball 51 and a rear end to connect a holder 53. The ball 51 is inserted in a rear portion of a movable jaw 52. A push plate 60 with a circular hole 61 thereon is disposed in the interior 32 between a compression spring 62 and the upper flange 43. A press plate 70 has an upper portion 71, a flat middle portion 72 and a lower portion 73. A center hole 74 is formed on the middle portion 72 of the press plate 70. The press plate 70 is inserted in the square hole 34, and the press plate 70 is confined by a rear wall of the fixed handle 30. The shaft 50 passes through the through hole 22, the circular hole 61, the rectangular hole 42, the elastic spring 54, and the center hole 74. A rivet p confines the operation of the driving handle 40.

Referring to FIG. 2, the driving handle 40 is pressed toward the fixed handle 30. The upper flange 43 forces the slant push plate 60 to drive the shaft 50 to move forward. The slant press plate 70 blocks the shaft 50 to move rearward. Referring to FIG. 3, the lower portion 73 of the press plate 70 is pressed forward to abut the fixed handle 30. The middle portion 72 of the press plate 70 is perpendicular to the shaft 50, so the press plate 70 will not block the motion of the shaft 50.

The invention is not limited to the above embodiment but various modification thereof may be made. Further, various changes in form and detail may be made without departing from the scope of the invention.

I claim:

1. A fast C-clamp comprising:

a generally C-shaped frame and a fixed jaw disposed in a front end of said frame;

a connecting end disposed at a rear end of said frame;

a fixed handle having an interior to receive a driving handle;

said driving handle having an upper flange disposed on an upper end of said driving handle, a pivot hole and a rectangular hole formed on an upper portion of said driving handle;

said fixed handle having a connecting hole thereon;

a pin passing through said connecting hole and said pivot hole to fasten said driving handle and said fixed handle together;

a circular holding seat disposed in a front of said fixed handle;

a lower flange with a slot therein disposed beneath said circular holding seat;

a through hole formed at a center of said circular holding seat;

said connecting end positioned in said slot stably;

a round hole formed on a rear upper portion of said fixed handle;

a square hole formed on said rear upper portion of said fixed handle under said round hole;

a round shaft having a front end to connect a ball and a rear end to connect a holder;

said ball inserted in a rear portion of a movable jaw;

a push plate with a circular hole thereon disposed in said interior between a compression spring and said upper flange;

a press plate having an upper portions a flat middle portion and a lower portion;

a center hole formed on said middle portion of said press plate;

said press plate inserted in said square hole, and said press plate confined by a rear wall of said fixed handle;

said shaft passing through said through hole, said circular hole, said rectangular hole, an elastic spring, and said center hole; and wherein said driving handle is pressed toward said fixed handle, and said upper flange forces said push plate to drive said shaft to move forward.

* * * * *